United States Patent [19]

Riddle et al.

[11] 4,058,194

[45] Nov. 15, 1977

[54] MULTIPLE DOCUMENT RECOGNITION APPARATUS

[75] Inventors: John B. Riddle, Los Altos Hills; Howard Z. Bogert, Jr., Cupertino, both of Calif.

[73] Assignee: Micro Magnetic Industries, Inc., Palo Alto, Calif.

[21] Appl. No.: 682,925

[22] Filed: May 4, 1976

[51] Int. Cl.[2] ..... G07F 7/04

[52] U.S. Cl. ..... 194/4 C

[58] Field of Search ..... 194/4 R, 4 C, 4 E; 235/61.7; 340/149; 250/569

[56] References Cited

U.S. PATENT DOCUMENTS

| | | | |
|---|---|---|---|
| 3,419,724 | 12/1968 | Bayha | 194/4 R |
| 3,937,926 | 2/1976 | Jones et al. | 194/4E |

*Primary Examiner*—Stanley H. Tollberg

*Attorney, Agent, or Firm*—Limbach, Limbach & Sutton

[57] ABSTRACT

Recognition apparatus is disclosed for recognizing multiple valued documents and for providing signals indicative of the value of each such document where the number of such signals is provided in a ratio of the value of the document to a base value.

5 Claims, 9 Drawing Figures

FIG. 3
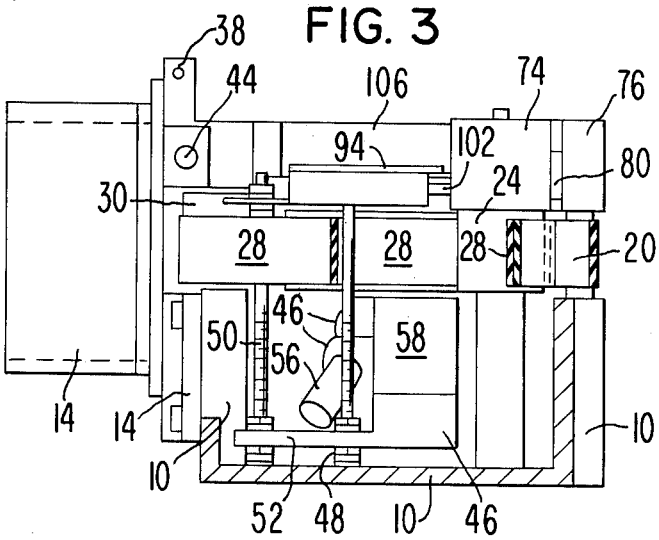
FIG. 5
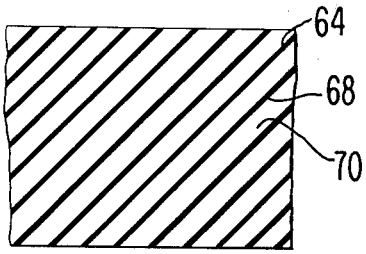
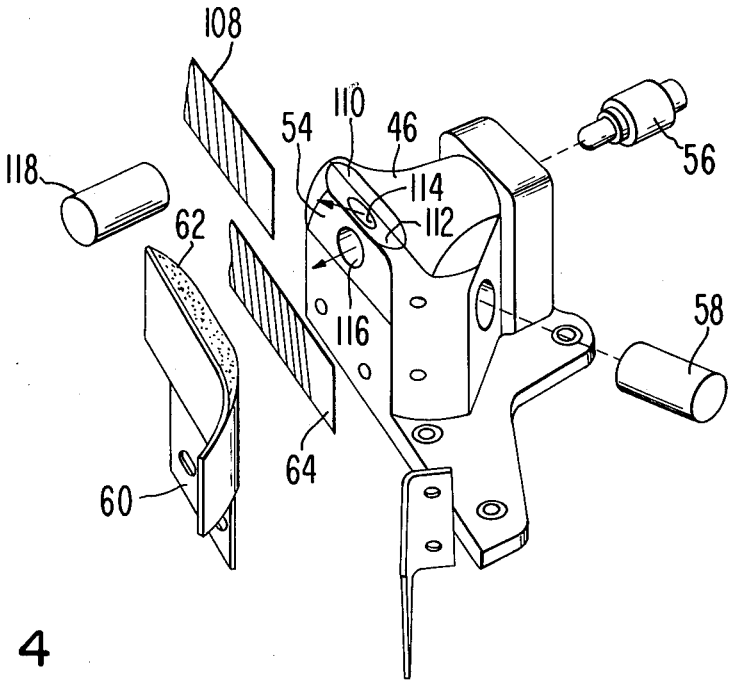
FIG. 4

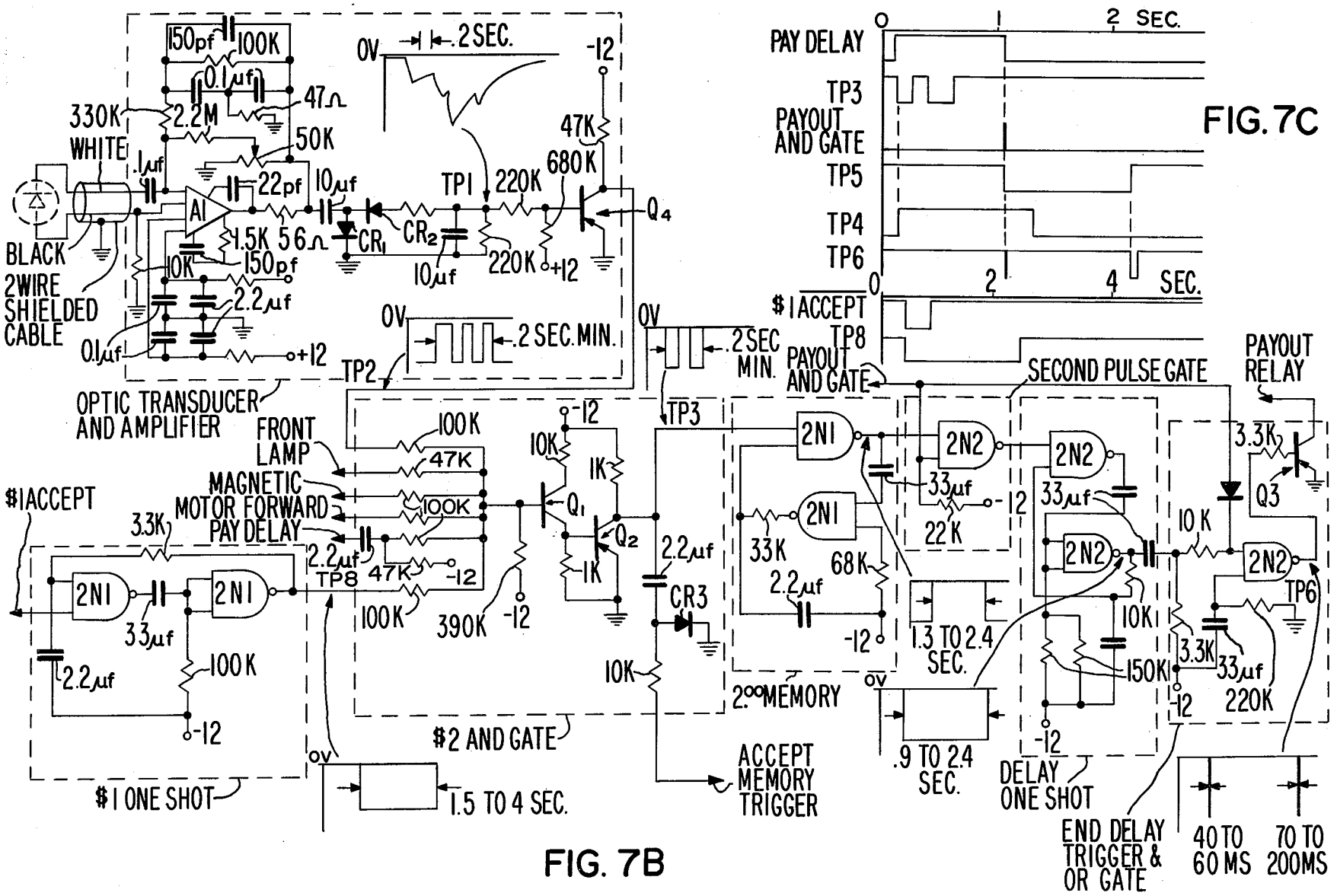
FIG. 7C
FIG. 7B
PAY DELAY
TP3
PAYOUT AND GATE
TP5
TP4
TP6
$1 ACCEPT
TP8
PAYOUT AND GATE
2 SEC.
SEC.
PAYOUT RELAY
SECOND PULSE GATE
END DELAY TRIGGER & OR GATE
DELAY ONE SHOT
70 TO 200MS
40 TO 60 MS
1.3 TO 2.4 SEC.
.9 TO 2.4 SEC.
2ND MEMORY
ACCEPT MEMORY TRIGGER
.2 SEC MIN.
.2 SEC. MIN.
.2 SEC.
$2 AND GATE
1.5 TO 4 SEC.
OPTIC TRANSDUCER AND AMPLIFIER
FRONT LAMP
MAGNETIC MOTOR FORWARD PAY DELAY
$1 ONE SHOT
$1 ACCEPT
WHITE
BLACK
2 WIRE SHIELDED CABLE
2N1
2N2
A1
Q1
Q2
Q3
Q4
CR1
CR2
CR3
TP1
TP2
TP3
TP6
TP8
-12
+12
0V

MULTIPLE DOCUMENT RECOGNITION APPARATUS

BACKGROUND OF THE INVENTION

The present invention relates to document recognizing apparatus and in particular to the recognition of documents to which are assigned varying values.

Apparatus for recognizing documents having attributes or values assigned to them are well-known in the art. See, for example, U.S. Pat. No. 3,256,968 entitled "Document Recognizing Apparatus." That patent describes apparatus for recognizing various attributes of paper currency and, in particular, a 1 dollar bill. More specifically, the apparatus described in that patent checks such attributes of the one dollar bill as its thickness, length, magnetic properties as provided by magnetic ink used to print the bill, and the recognition of the diagonal pattern of lines which appears on the inscription "ONE DOLLAR."

It is common to find apparatus of the type described in U.S. Pat. No. 3,256,968 which recognizes currency of other denominations such as 5 dollar bills and 10 dollar bills. Frequently, a single piece of equipment provides apparatus for changing multiple valued currency as, for example, 1 dollar bills and 5 dollar bills. Generally such equipment has independent electrical and mechanical apparatus for dispensing, in exchange for paper currency, 1 dollar's worth of change for a 1 dollar bill and 5 dollars' worth of change for a 5 dollar bill. In other words, parallel independent dispensing apparatus are generally provided for different values of currency.

With the recent reintroduction of the two dollar bill, even greater demand exists for currency recognition apparatus which can recognize multiple valued currency, particularly apparatus which can be purchased and installed at reasonable cost. With the two dollar bill, the problem has become even more acute, particularly for those who have already installed currency validating equipment which does not accept 2 dollar bills.

SUMMARY OF THE INVENTION

It is therefore an object of the invention to provide improved document recognition apparatus;

Another object of the invention is to provide improved document recognition apparatus for distinguishing multiple valued documents;

Another object of the invention is to provide improved currency validating apparatus incorporating common electrical and mechanical parts;

Another object of the invention is to provide currency recognition apparatus which can easily be retrofitted on existing currency recognition apparatus;

Another object of the invention is to provide failsafe multiple valued document recognition apparatus.

In accordance with the present invention, a document recognition device for distinguishing multiple valued items is provided which includes means for generating a serial train of signals which is related to the relative value assigned to the item. More specifically, a signal indicative of a base value is provided whenever a base value item is recognized, and in the case of higher valued documents, a train of signals is provided equal in number to the ratio of the value of the documents and the base value.

In accordance with another aspect of the invention, before a positive identification of one of a plurality of multiple value documents can be made, the absence of the identification attributes of other documents is required. This is done to insure failsafe operation.

The subject invention is particularly applicable to currency recognizing applications where it is desired to recognize or validate currency having different values such as 1 dollar and 2 dollar bills. The subject invention is particularly applicable for retrofitting existing single value currency recognizing apparatus to recognize additional values of currency.

In the latter regard, a feature of the invention is that it is possible to utilize existing electrical and mechanical parts of single value currency recognizing apparatus to a great extent thereby reducing the overall cost and expenses of retrofitting.

Thus, in accordance with another aspect of the invention, a multiple document recognizing device is provided which includes means for recognizing documents having higher levels of value than base level valued documents, means for stimulating the base value indicating means to provide a signal indicative of the base value, memory means for retaining the information that a higher value document has been recognized, and means for restimulating said base value indicating means, after a base value signal is provided, to provide additional base value signals according to the ratio of the value of the higher value document and the base value.

BRIEF DESCRIPTION OF THE DRAWINGS

FIG. 3 is a view in vertical section of the apparatus of FIGS. 1 and 2 taken along the plane indicated at 3—3 in FIG. 2;

FIG. 4 is an exploded view of the optical scanning means of FIGS. 1–3;

FIG. 5 is a face view of a portion of the optical scanning mask employed in the apparatus of FIG. 4;

FIGS. 7A and 7B are, respectively, a block and a detailed schematic diagram of a two dollar bill detector circuit.

DESCRIPTION OF THE PREFERRED EMBODIMENTS

Figure 1:
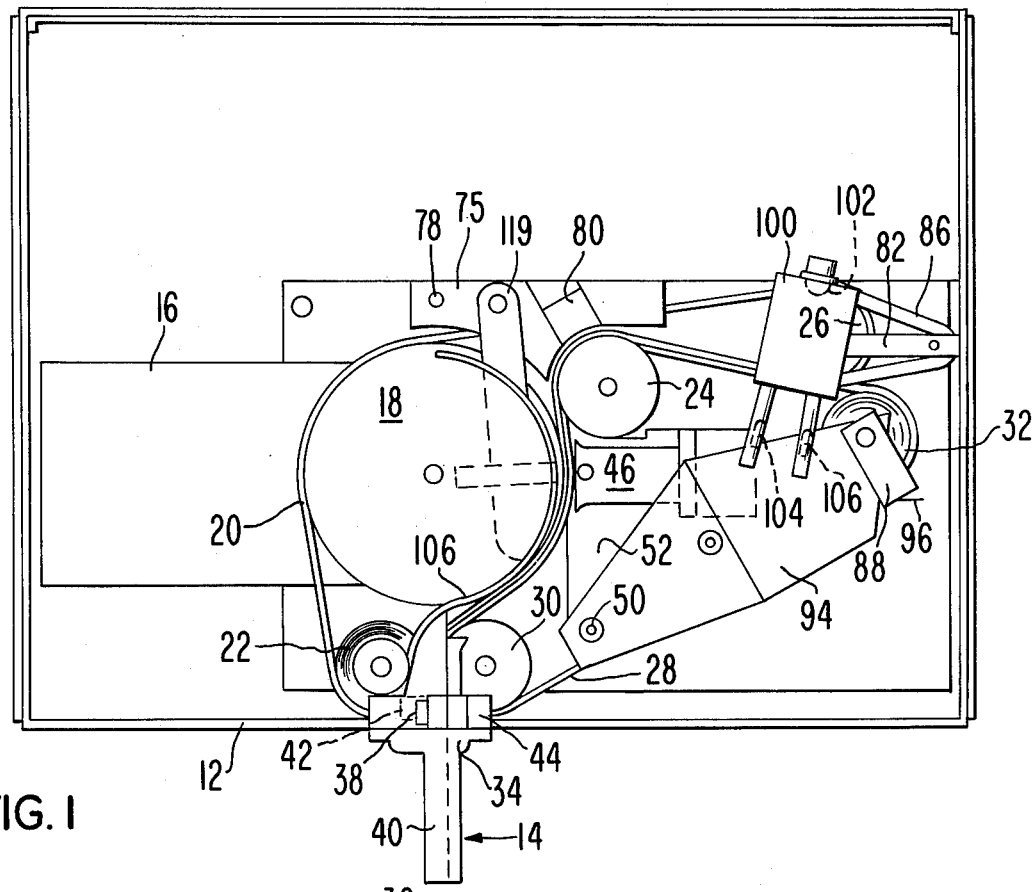
FIG. 1 is a top plan view of apparatus constructed in accordance with the principles of this invention with portions of the apparatus being omitted and broken away for clarity.
Figure 2:
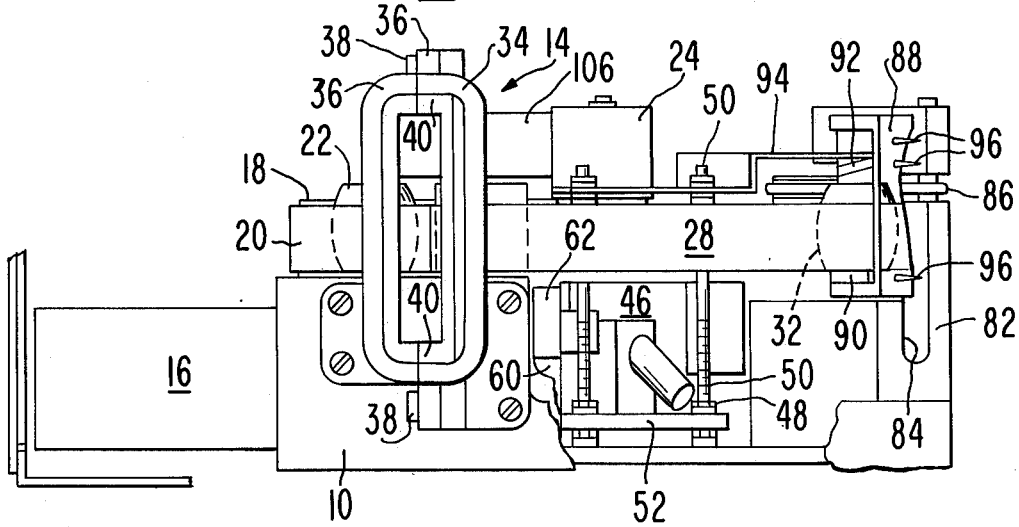
FIG. 2 is a view in front elevation of the apparatus of FIG. 1.

Referring now in detail to the drawings and particularly to FIGS. 1–3, the apparatus illustrated therein includes a frame 10 mounted in an enclosure 12 and carrying an entrance guide 14 projecting through an opening in the front of the enclosure 12 for guiding money along a linear path as it is introduced into the enclosure.

A reversible electric motor 16 is mounted on the frame 10 and supports a drive wheel 18 which engages an endless rubber belt 20 entrained over the drive wheel 18 and over idler rollers 22, 24 and 26. A second endless rubber belt 28 is entrained over idler rollers 30, 32 and 24 with the two belts 20 and 28 engaging each other along a path extending from the rollers 22 and 30 around the periphery of the drive roller 18 and periphery of the idler roller 24 to a position adjacent to the rollers 26 and 32. Along this path, the belts support and guide paper money through the enclosure, receiving money at the input guide 14 and discharging it at a discharge station adjacent to the roller 32. It should be noted that one roller on each belt is crowned, that is, the roller 22 on the belt 20 and the roller 32 on the belt 28, these crowned rollers providing effective means for maintaining the belts centered on the rollers.

The delivery chute 14 for delivering money into the enclosure 12 consists of a pair of cast body portions 34 and 36 secured together by screws 38. The body portion 34 carries a pair of flanges 40 spaced apart by a distance equal to the width of a piece of money for guiding the money into the apparatus along a longitudinal path. A light source 42 is mounted in the body 36 on one side of the path of money into the apparatus, and a photo-detector 44 is mounted on the body 34 in alignment with the light source 42 for detecting light transmitted through the path of the money, and the light source and photocell are mounted adjacent to the edge of the path so that they detect light transmitted through the portion of the path which is occupied by the unprinted edge of a bill. As explained hereinafter, the photo-detector 44 is connected to the motor 16 to start operation of the motor 16 when the intensity of light detected by the photocell is reduced to a predetermined limit indicating the introduction of a bill into the machine; the photocell 44 is further connected to means for reversing the motor 16 when the light intensity detected by the photocell 44 is reduced to a further predetermined limit as when an article inserted in the chute 14 is more opaque than money and does not transmit any light through the path to the photocell.

As illustrated in FIGS. 1–4, an optical scanning device is mounted adjacent to the path of the belts 20 and 28 in the area where the path is curved over the periphery of the drive roller 18. This optical scanning device includes a body portion 46 mounted on the frame 10 by means of nuts 48 received on a threaded rod 59 which is mounted on the frame 10 and engages a flange 52 on the body 46. The body 46 has a scanning face 54 which is tangent to the money path and the body 46 is bored to receive a light source 56 and a photo-detector 58 which are pointed toward the same local area of the face 54, the bores in which the light source and photocell are received extending completely through the body 46. A spring 60 is mounted on the body 46 and supports a foam plastic pad 62 in resilient engagement with the face 54 of the body 46 for firmly holding a bill in the path against the face of the scanning mechanism. A transparent mask 64 is mounted on the face 54 of the scanning mechanism so that the light source 56 and photocell 58 view money in the path through the mask 64.

As indicated in FIG. 5, the mask 64 carries a pattern of parallel lines 68 and 70 which are equal in width to the spaces and lines respectively in an area of the printed pattern on money, as for instance in the shaded background of the words "One Dollar" on the reverse side of U.S. money, and the lines and spaces are positioned to move into and out of coincidence with the spaces and lines on a piece of money when a piece of money moves along the path. In this regard, where this pattern of parallel lines and spaces is positioned to scan the words "One Dollar" the lines and spaces are inclined to a plane parallel to the length of the path and perpendicular to the face 54 by an angle of 32° which is the angle by which such lines in the words "One Dollar" are inclined to the longitudinal axis of a bill.

The photocell 58 is positioned to view a bill in the path along a direction perpendicular to the path, and the light source 56 is positioned to illuminate the path with a beam of light directed against the path at a compound angle positioned to illuminate the bill through the mask along a direction which is parallel to the lines of the mask so that the lines in the mask do not cast a shadow on the bill which is wider than the lines.

It will be noted from FIGS. 2 and 3 that the idler 24 projects upwardly above the belts 20 and 28 and is provided with a portion 74 of increased radius above the belt. The radius of the portion 74 equals the radius of the portion 24 plus the thickness of the belt 28 so that this portion 74 of one roller 24 engages and supports the portion of the bill above the belt as the belts go around this idler. An arm 76 is pivotally mounted on the frame 10 about a pivot arm 78 and is spring biased toward the roller portion 74 so that the arm 78 resiliently engages the face of a bill passing along the path. A magnetic detection head 89 is mounted in the arm 76 in engagement with the roller portion 74 for examining the printed pattern on the face of the bill and determining whether or not this pattern is printed with magnetizable ink. As indicated hereinafter, operation of the magnetic head 80 may be controlled by the detection of a suitable signal by the scanning means 46 so that the position on the bill which the magnetic head 89 analyzes may be controlled by the optical scanning mechanism, and so that the polarity of the magnetic signal may be reversed in selected places on the bill to determine the presence of both printed and unprinted areas.

Mounted adjacent to the discharge end of the belts 20 and 28 is a gate standard 82 having a recess therein facing toward the path of money being discharged from the belts. An auxiliary discharge belt 86 extends over the roller 26 and the gate standard for facilitating delivery of money from the belts. A chopper arm 89 is pivotally mounted on the axle of roller 32, supported thereon by a friction washer 90 and a spring 92 which cause the arm 88 to rotate in the same direction as the roller 32. A frame 94, mounted on top of the threaded rods 50, engages the upper end of the arm 88, limiting rotation of the arm 88 in the clockwise direction as the apparatus is viewed in FIG. 1. The outer end of the arm 88 carries a plurality of very sharp needles 96 positioned to enter the slot 84 in gate standard 82 when the arm 88 rotates counterclockwise in the direction in which belts 20 and 28 move while discharging money from the input end of the apparatus. With the pivotal axis of the arm 88 being located close to the path location of the slot 84 but slightly to the left of it as it is viewed in FIG. 1, the arm 88 with its needles 96 exerts a wedging action on a bill caught between the gate standard 82 and needles 96 so that attempted withdrawal of a bill from such position toward the input end of the path causes the needles 96 to puncture the bill and sever from the bill a portion thereof which is kept in the machine. The chopping gate 88 is positioned at such a location along the path of the belt that a bill one accepted by the apparatus cannot be removed by a trailer without leaving more than half of the bill in the apparatus.

Also attached to the frame 10 is a rear light assembly 100 which consists of a lamp 102 and first and second photocells 104 and 106. The bill length can be measured as the bill moves at 6 inches per second by the drive motor 16. A valid bill is 6 inches long and, therefore, an allowed time interval between when the light to photocell 104 is blocked and then opened by the bill will indicate its length. This latter operation and the function of the photo-detector 104 will be discussed in the following description of the block schematic diagram of FIG. 6.

In addition to the mask 64, a second mask 108 (FIG. 4) is provided as a part of the optical scanning device. The second mask 108 is provided to enable the identification of a second type of bill denomination. Mask 108 also carries a pattern of parallel lines and spaces as does mask 64 but the pattern is different from that of mask 64. Mask 108 can be designed to detect a particular pattern on any type of currency but for purposes of this invention disclosure, it is assumed that mask 108 is used to detect a 2 dollar bill.

For a two dollar bill mask 108 is provided with lines 10 mils apart and is positioned with respect to the body 46 such that it is adjacent to the portrait of Thomas Jefferson on the 2 dollar bill as it is sent through the scanning section. The lines on mask 108 are chosen to coincide with the vertical lines of the background shading in the oval surrounding Jefferson's head.

Body 46 is provided with notched-out portion 110 which provides a face 112 generally perpendicular to face 54. An aperture 114 is provided to intersect with the aperture 116 through which passes light emitted from the light 56. In this manner light is directed through aperture 114, through the two dollar bill, through the mask 108 and finally to a photo-detector 118. As shown in FIG. 1, photo-detector 118 is provided within a masking block 119 which is secured to frame 10. Photo-detector 118 is mounted such that belt 20 does not block the path to it from the light source.

Photo-detector 118 detects the pattern created by the interaction between the two dollar bill and the mask 108 just as photo-detector 58 picks up and detects the interaction between the 1 dollar bill surface and the mask 64. Note, however, that in the case of a 2 dollar bill, the detector 118 senses light which passes through the bill, whereas the 1 dollar bill pattern is detected from light reflecting from the surface of the bill.

Figure 6:
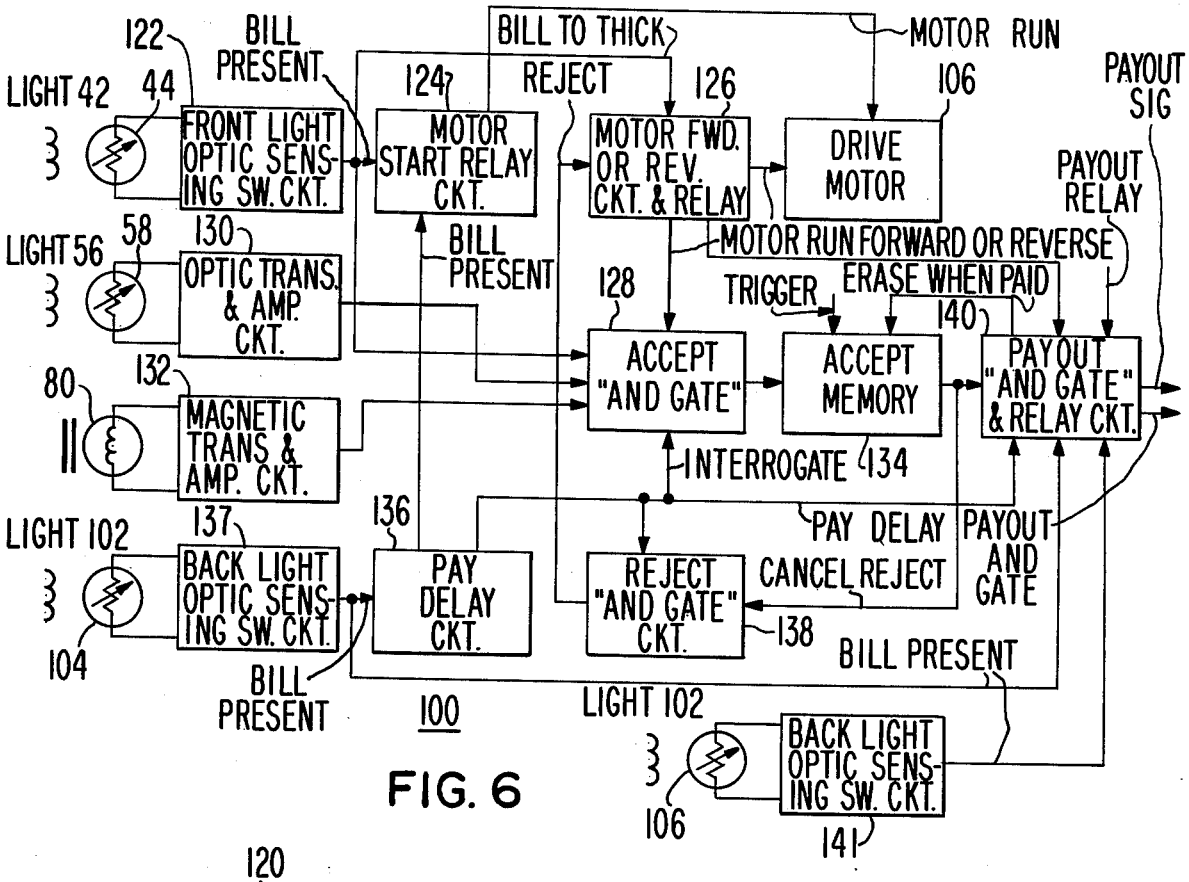
FIG. 6 is a block schematic diagram of the control circuit of a conventional design for effecting one dollar bill validation of the apparatus depicted in FIGS. 1–3.

Reference is now made to FIG. 6, which is a block schematic diagram of a control circuit 120 of conventional design for effecting 1 dollar bill operation of the apparatus depicted in FIGS. 1–5. Specifically, circuit 120 is the circuit for a dollar bill validator made by Micro-Magnetic Industries, Inc., of Palo Alto, California, designated Model 1300. A valid bill is inserted into the bill entrance guide 14 with the picture up and facing to the left. The bill partially blocks the beam of light from scan light 42 to the optic cell 44. The proper shading of this light causes photo-detector 44 and its associated switching circuitry 122 to energize relay 124, the forward rotation relay. When relay 124 is energized, drive motor 106 is started and rotates in a counterclockwise direction, pulling the bill into the validator. Thinner paper than a valid bill will allow too much light to fall on photocell 44 and the motor 106 does not run. Paper thicker than a valid bill blocks too much light and photocell 44 energizes relay 124 and also relay 126. Relay 126 causes the motor to run in a clockwise rotation, moving the bill back out of the input chute.

If the bill is of the proper thickness, it will continue to move forward until the front edge of the bill breaks the light to photo-detector 104. At this point the bill has completely entered the validator and the trailing edge of the bill is no longer covering the front light 42. When the bill breaks the light to photo sensor 104, the pay delay circuit 136 is triggered via the back light optic sensing and switch circuit 137 and emits a pay delay pulse of approximately 0.8 second duration. This pulse interrogates the accept AND gate 128. The other conditions to the AND gate are:

1. The motor must be running in the forward direction.

2. The front light must be uncovered. This causes the machine to reject bills which have something tied to them to allow them to be pulled back out of the machine.

3. A signal must be coming from the optic transducer and amplifier circuit 130. This circuit checks a moire pattern of a 1 dollar bill as explained above.

4. A signal must be present from the magnetic transducer and amplifier circuit 130. This circuit checks the magnetics of the bill as explained above.

When the accept AND gate 128 is satisfied, it emits a pulse which triggers the accept memory 134. The purpose of the accept memory 134 is to retain the fact that the accept AND gate 128 was satisfied at some previous time after the signal from the accept AND gate 128 has disappeared. If the accept AND gate 128 is not satisfied when the pay delay interrogates it, the motor is reversed and the bill is backed out of the machine. This is accomplished by providing the pay delay signal from pay delay circuit 136 to reject AND gate 138. If no signal is present from the accept memory 134, the reject AND gate 128 actuates the motor forward or reverse circuit and relay 126 to cause the bill to be backed out.

The bill continues to move through the validator until the trailing edge of the bill uncovers photosensor 104. The payout AND gate and relay circuit 140, which provides a "payout signal" to pay out change has the potential of being satisfied when photosensor 104 is uncovered and photosensor 106 is covered, which is noted by a signal from back light optic sensing and switching circuit 141 to payout AND gate circuit 140. In this manner the trailing edge of the bill is sensed. Payout occurs, i.e. a signal from payout gate 140 is provided, if three other conditions are also present.

1. The pulse from the pay delay circuit 136 must have ended. This condition means that the trailing edge of the bill must go by photosensor 104 at least 0.8 second after the leading edge passes photosensor 104. This condition causes the machine to reject short bills.

2. The accept memory 134 must be emitting a signal which indicates the accept AND gate had previously been satisfied. The accept memory pulse has a maximum 1.2 seconds. This prevents extra long bills from being accepted.

3. The motor must be running in the forward direction.

When all conditions to the payout AND gate are satisfied, the payout relay 140 is energized and a payout signal is emitted from the validator.

Figure 7A:
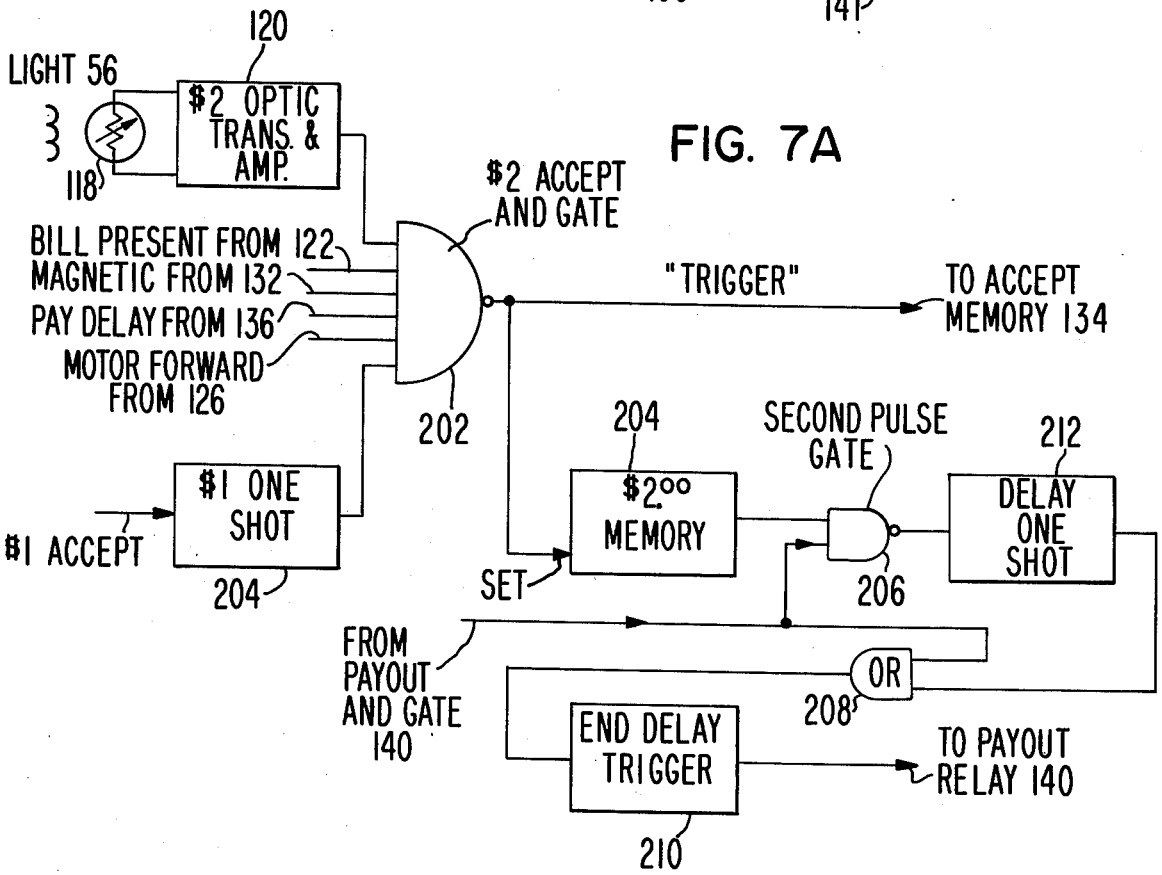

FIG. 7A is a block diagram of a two dollar detector circuit 200 which can easily be adopted in combination with the one dollar control circuit 100 of FIG. 6. FIG. 7B is a detailed schematic diagram of the 2 dollar recognize circuit 200. AND gate 202 is provided with six inputs. The first input results from the pattern detection by photo-detector 118, which senses the particular pattern identified on a 2 dollar bill. A transducer and amplifier circuit 120 provides a signal to one of the inputs of AND gate 202.

The next four inputs are occupied by the same inputs provided to accept AND gate 128 of FIG. 6. Specifically, the "BILL PRESENT" signal is provided from photo-detector 42, the magnetic "INPUT" is provided from transducer 80, the "PAY DELAY" input is provided from pay delay circuit 136 and the "MOTOR FORWARD" is provided from relay 126.

As a unique feature of circuit 200, another input is provided from the one dollar validation circuit 100. More specifically, a signal is provided from accept AND gate 128 to a 1 dollar one-shot multivibrator 104 which, in turn, is provided to the sixth input of the 2 dollar accept AND gate 202. The function of the 1 dollar one-shot 204 is to emit a signal which prevents the 2 dollar accept AND gate 202 from being satisfied when a 1 dollar bill is being read. Normally this occurs in any event. The 1 dollar one-shot simply serves as an added safety factor.

For a trigger signal to be provided from AND gate 202, all six inputs must be positive and there must be the absence of a 1 dollar bill in the validator. In the case of the absence of a 1 dollar bill, no accept is provided from AND gate 128 (FIG. 6). With multivibrator 204 acting as an inverter, it is thus apparent that the proper condition is met to provide a trigger signal when the input to multivibrator 204 is "off."

With all of the inputs to AND gate 202 high, a trigger is provided to the accept memory 128 of FIG. 6. This activates the accept memory 134 and prevents the reject AND gate 138 from actuating the motor forward or reverse circuit 126, thereby preventing the bill being returned to the customer while at the same time giving change. When the trailing edge of the bill passes photosensor 104, the payout AND gate 140 is satisfied in the normal fashion.

When the 2 dollar detector circuit 200 is incorporated with a 1 dollar validator having the control circuit shown in FIG. 6, the payout AND gate and relay circuit 140 is connected in a manner so that the payout AND gate 140 actuates its relay by passing the activating signal through the 12 dollar detector circuit 200. This is accomplished by providing the activating signal from the payout AND gate 140 to an OR circuit 208 which actuates the end delay trigger 210 and in turn the payout relay of 140 (FIG. 6).

When a 1 dollar bill is read, the payout signal also passes through the 2 dollar detector circuit 200. When the two dollar accept AND gate 202 emits a pulse to trigger the accept memory 134, it also triggers the 2 dollar memory 204. This memory functions like the accept memory 134 except that it remembers that the two dollar AND gate 202 has been satisfied at some point in time. It emits a pulse of approximately 1.2 seconds duration. When the rear of the bill uncovers photo-detector 104, the payout AND gate 140 is satisfied and, as previously described, causes the payout relay of 104 to close.

The signal from the payout AND gate 140 is also read to second pulse gate 206. If the two dollar memory is emitting a pulse which indicates that the two dollar accept AND gate had been satisfied at some previous time, the second pulse gate 206 allows the signal from the payout AND gate 140 to trigger a delay one-shot 212.

This one-shot is approximately 1.2 seconds in duration but provision is made for doubling that time in some equipment. The delay one-shot 212 is read through OR circuit 208 to the end delay trigger 210. When the signal from the delay one-shot 212 ends, it causes the end delay trigger 210 to actuate the payout relay 140 a second time. The length of time the payout relay is closed is controlled by the validator itself and not by the 2 dollar detector circuit 200.

What is claimed is:

1. A multi-document recognition device comprising:

a. means for recognizing documents having a base level of value;

b. means responsive to said recognizing means for providing a signal indicating that such a base value has been recognized; and c. means for recognizing documents having higher levels of value than said base level including:

i. means for stimulating said base value indicating means to provide a signal indicative of the base value;

ii. memory means for retaining the information that a higher value document has been recognized, and iii. means for re-stimulating said base value indicating means, after a base value signal is provided, to provide additional base value signals according to the ratio of the value of the higher value document and the base value.

2. A multiple document recognizing device as in claim 1 wherein said means for recognizing documents having higher levels of value than said base level includes means requiring the absence of recognition of other possible valued documents.

3. A currency recognizing device comprising:

a. means for recognizing lowest denomination currency;

b. means responsive to said recognizing means for providing a signal indicating that such lowest denomination currency has been recognized, and c. means for recognizing higher values of currency than said lowest denomination of currency, including i. means for stimulation said lowest denomination indicator means to provide a signal indicative of the lowest denomination;

ii. memory means for retaining the information that a higher denomination currency has been recognized, and iii. means for re-stimulating said lowest denomination indicating means, after a lowest denomination signal is provided, to provide additional lowest denomination signals according to the ratio of the value of the higher denomination currency and the lowest denomination currency.

4. A currency recognizing device as in claim 3 wherein said means for recognizing lowest denomination currency having higher levels of value than said base level includes means requiring the absence of recognition of other denominations of currency.

5. A currency recognizing device as in claim 3 including means responsive to each lowest denomination signal for providing coin change equal in value to said lowest denomination currency.

* * * * *

UNITED STATES PATENT AND TRADEMARK OFFICE

CERTIFICATE OF CORRECTION

PATENT NO. : 4,058,194

DATED : 15 November 1977

INVENTOR(S) : John B. Riddle and Howard Z. Bogert, Jr.

It is certified that error appears in the above-identified patent and that said Letters Patent are hereby corrected as shown below:

Column 7, line 11, number "104" should read --204--;

Column 7, line 41, number "12" should read --2--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*